US007547228B1

(12) United States Patent
Schlarman

(10) Patent No.: US 7,547,228 B1
(45) Date of Patent: Jun. 16, 2009

(54) JOINING MEANS FOR DEVICE COMPONENTS

(75) Inventor: Chris Schlarman, Chandler, AZ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 12/170,919

(22) Filed: Jul. 10, 2008

(51) Int. Cl.
*H01R 31/08* (2006.01)

(52) U.S. Cl. ..... 439/507

(58) Field of Classification Search ..... 439/92, 439/507, 33; 361/804, 742, 758, 756, 759, 361/807–710; 174/177 G, 177 F, 138 G, 174/138 D See application file for complete search history.

(56) References Cited

U.S. PATENT DOCUMENTS 2,943,242 A 6/1960 Schaschl et al.
3,728,468 A 4/1973 Grauer
4,715,085 A 12/1987 Johanson
5,415,587 A 5/1995 Fenley
5,491,892 A * 2/1996 Fritz et al. ..... 29/857
5,519,169 A * 5/1996 Garrett et al. ..... 174/371
5,836,202 A 11/1998 Hobbs
5,973,903 A 10/1999 Tomerlin
6,230,585 B1 5/2001 Bator
6,283,771 B1 9/2001 Mitchell et al.
6,530,694 B2 3/2003 Takemura
7,349,222 B2 * 3/2008 Kim ..... 361/758

* cited by examiner

*Primary Examiner*—Phuong K Dinh
(74) *Attorney, Agent, or Firm*—Ingrassia Fisher & Lorenz, P.C.

(57) ABSTRACT

A joining means for thermally insulating and electrically coupling a first component and a second component at an interface. The joining means including a joining bolt, at least one thermally insulating spacer, and an electrically conductive bracket. The at least one thermally insulating spacer including an opening formed therein and positioned between the first component and the second component to provide thermal insulation between the first component and the second component. The electrically conductive bracket including a first end coupled to the joining bolt between the first component and the at least one spacer and a second end coupled to the joining bolt between the second component and the at least one spacer. The electrically conductive bracket establishing an electrical circuit between the first component and the second component.

20 Claims, 2 Drawing Sheets

JOINING MEANS FOR DEVICE COMPONENTS

TECHNICAL FIELD

The present invention generally relates to the joining of device components, and more particularly relates to the joining of device components in a manner that limits thermal conductivity between the two components, while maintaining electrical conductivity.

BACKGROUND

In many devices, it is desirable to limit heat transfer between components. At the same time, it is desirable for electrical conductivity or an electrical bonding path to be maintained between components. In many instances, implementing thermal insulating properties between components, results in a high electrical resistance. This high electrical resistance may result in the build-up of static charge, which may potentially lead to equipment damage, interference with communications, sparking or a shock hazard.

One current method utilizes a plurality of spacers at a bolted interface between two device components, such as a hot flow body and an aluminum actuator. While the plurality of spacers provide a rigid mechanical interface with adequate thermal insulation between the hot flow body and the aluminum actuator, the spacers also generate electrical resistance and may make the components susceptible to electrical damage.

Therefore, there is a need for a means for joining two components in a device that will limit thermal conduction and provide a low electrical resistance bonding path. Furthermore, other desirable features and characteristics of the inventive subject matter will become apparent from the subsequent detailed description of the inventive subject matter and the appended claims, taken in conjunction with the accompanying drawings and this background of the inventive subject matter.

BRIEF SUMMARY

The present invention provides a joining means for thermally insulating and electrically coupling a first component and a second component at an interface. In one embodiment and by way of example only, the joining means comprises a joining bolt, at least one thermally insulating space and a bracket. The joining bolt is configured to mechanically couple the first component and the second component. The at least one thermally insulating spacer includes an opening formed therein and is positioned between the first component and the second component, wherein the joining bolt is disposed within the opening. The at least one thermally insulating spacer provides thermal insulation between the first component and the second component. The bracket includes a first end coupled to the joining bolt between the first component and the at least one thermally insulating spacer and a second end coupled to the joining bolt between the second component and the at least one thermally insulating spacer. The bracket establishes an electrical circuit between the first component and the second component.

In another particular embodiment, and by way of example only, there is provided a joining means comprising a joining bolt configured to couple the first component to the second component at the interface; a plurality of thermally insulating spacers having an opening formed therein and configured in a stacked arrangement between the first component and the second component, and an electrically conductive bracket having a first end coupled to the joining bolt between the first component and an adjacent one of the plurality of thermally insulating spacers and a second end coupled to the joining bolt between the second component and an adjacent one of the plurality of thermally insulating spacers. The joining bolt extending from the second component through the first component and disposed within the opening formed in each of the plurality of thermally insulating spacers.

In yet another particular embodiment, and by way of example only, there is provided a joining means comprising a joining bolt extending between the first component and the second component and coupling the first component and the second component at the bolted interface, a plurality of thermally insulating disc shaped spacers having an opening formed therein and configured in a stacked arrangement between the first component and the second component, and an electrically conductive bracket having a first end coupled to the joining bolt between the first component and one of the plurality of thermally insulating shaped spacers and a second end coupled to the joining bolt between the second component and one of the plurality of thermally insulating disc shaped spacers. The joining bolt is disposed within. The first end and the second end of the bracket each include a rounded eyelet for encircling the joining bolt extending between the first component and the second component.

Other independent features and advantages of the preferred joining means for thermally insulating and electrically coupling a first component and a second component at an interface will become apparent from the following detailed description, taken in conjunction with the accompanying drawings which illustrate, by way of example, the principles of the invention.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

The embodiment disclosed herein is described in sufficient detail to enable those skilled in the art to practice the invention, and it is to be understood that other embodiments may be utilized and that logical, mechanical and electrical changes may be made without departing from the scope of the present invention. Furthermore, it will be understood by one of skill in the art that although the specific embodiment illustrated below is directed at the joining of a hot flow body and an actuator for purposes of explanation, the apparatus may be used in various other embodiments employing various types of components that are require thermal insulation, while being electrically joined. The following detailed description is, therefore, not to be taken in a limiting sense.

Figure 1:
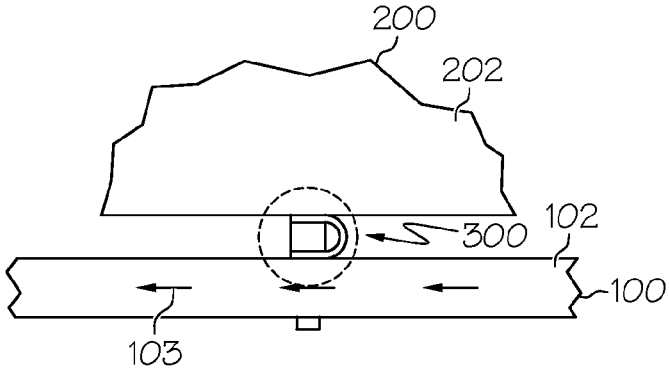
FIG. 1 is schematic representation of two components joined by a joining means according to an embodiment.

Referring now to the accompanying figures, FIG. 1 illustrates a first component 100 and a second component 200 joined together by a joining means 300. In this specific embodiment, first component 100 is a hot flow body 102, typically found in a number of valve applications, such as those found in aircraft embodiments. The second component 200 is an actuator 202, such as an aluminum valve actuator, commonly used for the actuation of a flow body, such as the hot flow body 102. In this preferred embodiment, the first component 100, and more particularly the flow body 102, is a high temperature component having a fluidic flow 103 therethrough, and the second component 200, and more particularly the actuator 202, is a lower temperature component. During operation it is desired to limit the heat transfer from the first component 100 to the second component 200. Simultaneously, it is desired to maintain electrical conductivity between the first component 100 and the second component 200.

Figure 2:
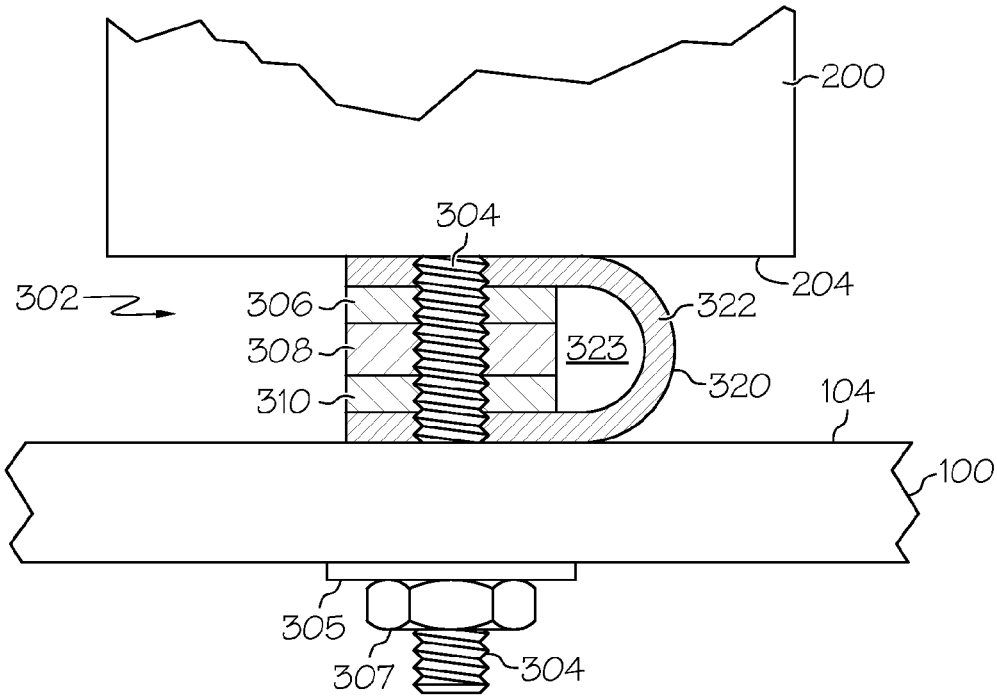
FIG. 2 is a close-up partial cross-section view of a portion of FIG. 1 showing the joining means according to an embodiment.

Referring now to FIG. 2, illustrated is a simplified close up view of a portion of FIG. 1, the joining means 300 being shown in cross-section. More specifically, illustrated is the joining means 300 positioned proximate a bolted interface 302 of the first component 100 and the second component 200. As illustrated, a joining bolt 304 is used to join the first component 100 and the second component 200. In the illustrated embodiment, the joining bolt 304 extends through the first component 100 and is secured with an optional washer 305 and a fastener 307, such as a nut. At least one spacer is positioned between the first component 100 and the second component 200. In this embodiment, a plurality of spacers 306, 308, and 310 are positioned between a surface 104 of the first component 100 and a surface 204 of the second component 200. The plurality of spacers 306, 308 and 310 are generally disc-shaped having an opening in the center to allow disposition of the joining bolt 304 therethrough. More specifically, during assembly the plurality of spacers 306, 308, 310 are positioned on the joining bolt 304 and provide in combination a rigid mechanical interface between the first component 100 and the second component 200. The plurality of spacers 306, 308 and 310 thermally insulate the second component 200 from the first component 100. The thermal insulation provided by the plurality of spacers 306, 308 and 310 reduces heat transfer between the two components which reduces the potential for thermal damage to the second component 200. The plurality of spacers 306, 308, and 310 are formed of a thermally insulative material such as thermally insulative metal, including stainless steel, rigid thermal insulation, or the like. In this preferred embodiment the plurality of spacers 306, 308 and 310 are formed of stainless steel.

In addition, although this preferred embodiment is described and illustrated as including three spacers to provide the necessary thermal insulation between the first component 100 and the second component 200, it should be understood that any number of spacers, or a single spacer, formed in any number of shapes, may be utilized dependent upon the specific thermal insulation properties required. The plurality of spacers 306, 308 and 310 in combination with the joining bolt 304 provide a rigid mechanical interface between the first component 100 and the second component 200 with relatively high resistance to heat transfer.

Figure 3:
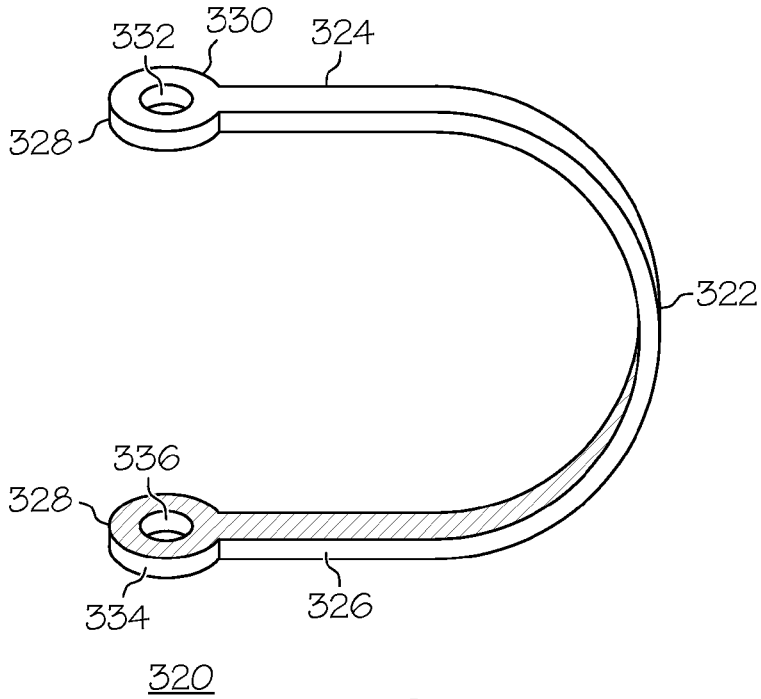
FIG. 3 is a close-up isometric view of a portion of the joining means of FIGS. 1 and 2.

The joining means 300 further includes an electrically conductive joining component 320 in the form of a bracket 322. The bracket 322 is further illustrated in an enlarged isometric view in FIG. 3. The bracket 322 in a preferred embodiment is substantially U-shaped, but may be formed into an alternate shape depending upon design requirements. The bracket 322 is shaped to allow for coupling of the bracket 322 to the first component 100 and the second component 200, yet allow for an airspace 323 (FIG. 2) between a side aspect of the plurality of spacers 306, 308, 310 and the bracket 322. The bracket 322 has formed at opposed first and second ends 324 and 326, respectively, a securing means 328 for attaching the bracket 322 about the joining bolt 304. In this preferred embodiment, the bracket 322 has formed at the first end 324 a first rounded eyelet 330 for encircling the joining bolt 304 and at the second end 326 a second rounded eyelet 334 for encircling the joining bolt 304. The first rounded eyelet 330 includes an opening 332 and the second rounded eyelet 334 includes an opening 336 formed therein through which the joining bolt 304 is disposed.

Figure 4:
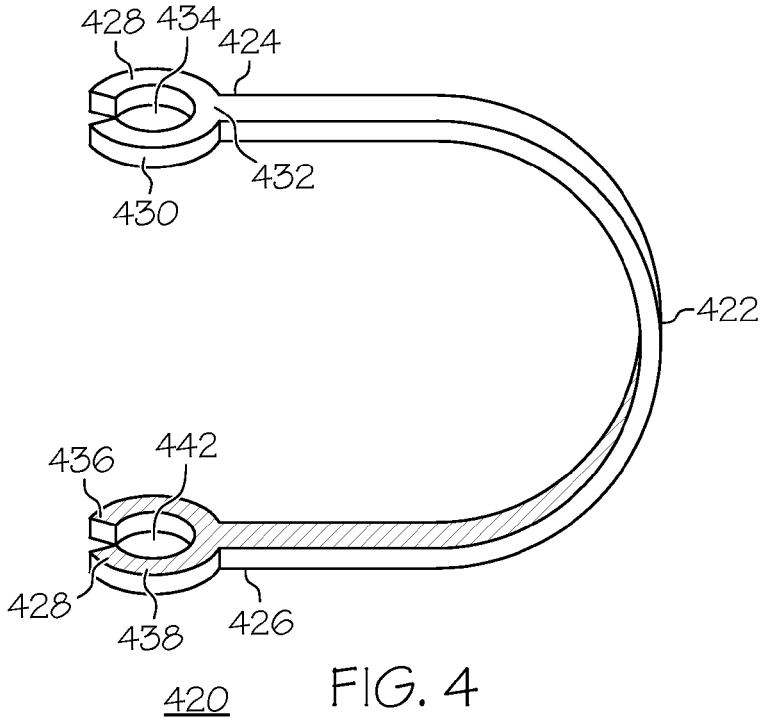
FIG. 4 is a close-up isometric view of an alternate joining component according to an embodiment.

As best illustrated in FIG. 4, is an alternate embodiment of an electrically conductive joining component 420, and more particularly a bracket 422. The bracket 422, similar to the first embodiment, is substantially U-shaped, but may be formed into an alternate shape depending upon design requirements. The bracket 422 is shaped to allow for coupling of the bracket 422 to the first component 100 and the second component 200. The bracket 422 includes opposed first and second ends 424 and 426, respectively, and each having formed a securing means 428 for attaching the bracket 422 about the joining bolt 304. In this embodiment, the bracket 422 has formed at the first end 424 a first rounded arm 428 and a second rounded arm 430 joined at an apex 432 and defining and opening 434 for encircling the joining bolt 304. The bracket 422 has formed at the second end 426 a first rounded arm 436 and a second rounded arm 438 joined at an apex 440 and defining and opening 442 for encircling the joining bolt 304

Irrespective of the shape of the securing means 328 or 428, in a preferred embodiment the bracket is formed of an electrically conductive material, such as stainless steel, nickel alloy, copper, aluminum, or the like. In this illustrated embodiments, the brackets 322 and 422 are formed of stainless steel and have a thickness in a range of 0.005 to 0.010 inches. It should be understood that a bracket having a greater or lesser thickness is anticipated by this disclosure dependent upon the material chosen and overall design of the joining component 320 and 420. The bracket 322 and 422 creates a short circuit or electrical shunt through which the current will travel. Through the selection of an appropriate material, shape, and dimensions, a trade between electrical conductivity and electrical resistance occurs. The joining means 300 provides thermal insulation between the first component 100 and the second component 200 via the plurality of spacers 306, 308 and 310 while the joining component 320 and 420, and more particularly the bracket 322 and 422, provides an electrical path between the first component 100 and the second component 200.

Accordingly, disclosed is a joining means for device components, such as those commonly found in aircraft applications, that provides a means of mechanically joining two device components while limiting thermal conduction and assuring low electrical resistance.

While at least one exemplary embodiment has been presented in the foregoing detailed description of the invention, it should be appreciated that a vast number of variations exist. For example, although the specific embodiments illustrated are directed at joining a flow valve and an actuator, such as those found in an aircraft, the method and apparatus may be used in various embodiments employing various types of device components, such as electrical enclosures, electronic equipment, pumps, mechanical housings, etc. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A joining means for thermally insulating and electrically coupling a first component and a second component at an interface, the joining means comprising:

a joining bolt configured to mechanically couple the first component and the second component;

at least one thermally insulating spacer having an opening formed therein, the at least one thermally insulating spacer positioned between the first component and the second component, wherein the joining bolt is disposed within the opening, the at least one thermally insulating spacer providing thermal insulation between the first component and the second component; and a bracket having a first end coupled to the joining bolt between the first component and the at least one thermally insulating spacer and a second end coupled to the joining bolt between the second component and the at least one thermally insulating spacer, the bracket establishing an electrical circuit between the first component and the second component.

2. A joining means as claimed in claim 1, wherein the first end of the bracket includes a connection means defined by a rounded eyelet for encircling the joining bolt.

3. A joining means as claimed in claim 2, wherein the second end of the bracket includes a connection means defined by a rounded eyelet for encircling the joining bolt.

4. A joining means as claimed in claim 1, wherein the first end of the bracket includes a connection means defined by two arms joined at an apex.

5. A joining means as claimed in claim 4, wherein the second end of the bracket includes a connection means defined by two arms joined at an apex.

6. A joining means as claimed in claim 1, wherein the at least one thermally insulating spacer is formed of a stainless steel material.

7. A joining means as claimed in claim 1, further including a first thermally insulating spacer, a second thermally insulating spacer and a third thermally insulating spacer.

8. A joining means as claimed in claim 7, wherein the first, second and third thermally insulating spacers are formed of a stainless steel material.

9. A joining means as claimed in claim 1, wherein the bracket is formed of an electrically conductive material.

10. A joining means for thermally insulating and electrically coupling a first component and a second component at an interface, the joining means comprising:

a joining bolt configured to couple the first component to the second component at the interface;

a plurality of thermally insulating spacers having an opening formed therein, the plurality of thermally insulating spacers configured in a stacked arrangement between the first component and the second component, wherein the joining bolt extends from the second component through the first component and is disposed within the opening formed in each of the plurality of thermally insulating spacers; and an electrically conductive bracket having a first end coupled to the joining bolt between the first component and an adjacent one of the plurality of thermally insulating spacers and a second end coupled to the joining bolt between the second component and an adjacent one of the plurality of thermally insulating spacers.

11. A joining means as claimed in claim 10, wherein the plurality of thermally insulating spacers are disc shaped.

12. A joining means as claimed in claim 10, wherein the first end of the electrically conductive bracket includes a rounded eyelet for encircling the joining bolt extending between the first component and the second component.

13. A joining means as claimed in claim 12, wherein the second end of the electrically conductive bracket includes a rounded eyelet for encircling the joining bolt extending between the first component and the second component.

14. A joining means as claimed in claim 10, wherein the first end of the electrically conductive bracket includes a connection means defined by two arms joined at an apex.

15. A joining means as claimed in claim 14, wherein the second end of the electrically conductive bracket includes a connection means defined by two arms joined at an apex.

16. A joining means as claimed in claim 10, wherein the plurality of thermally insulating spacers are formed of a stainless steel material and the electrically conductive bracket is formed of a stainless steel material.

17. A joining means as claimed in claim 10, wherein the plurality of thermally insulating spacers includes a first thermally insulating spacer, a second thermally insulating spacer and a third thermally insulating spacer positioned in a stacked arrangement.

18. A joining means for thermally insulating and electrically coupling a first component and a second component at a bolted interface, the joining means comprising:

a joining bolt extending between the first component and the second component and coupling the first component and the second component at the bolted interface;

a plurality of thermally insulating disc shaped spacers having an opening formed therein and configured in a stacked arrangement between the first component and the second component, wherein the joining bolt is disposed within the opening formed in each of the plurality of thermally insulating disc shaped spacers; and an electrically conductive bracket having a first end coupled to the joining bolt between the first component and one of the plurality of thermally insulating shaped spacers and a second end coupled to the joining bolt between the second component and one of the plurality of thermally insulating disc shaped spacers, wherein the first end and the second end each include a rounded eyelet for encircling the joining bolt extending between the first component and the second component.

19. A joining means as claimed in claim 18, wherein the electrically conductive bracket is formed of a stainless steel material.

20. A joining means as claimed in claim 18, wherein the first component is a flow body and the second component is an actuator.

* * * * *